US006077460A

United States Patent [19]

Oppenlander et al.

[11] Patent Number: 6,077,460

[45] Date of Patent: Jun. 20, 2000

[54] CORROSION INHIBITION

[75] Inventors: Knut Oppenlander, Ludwigshafen; Gunter Oetter, Frankenthal; Rudi Kroner, Mannheim; Norbert Mahr, Ludwigshafen; Hans-Jurgen Jatzek, Heidelberg; Klaus Taeger, Freinsheim, all of Germany

[73] Assignee: BASF Aktiengesellschaft, Germany

[21] Appl. No.: 09/229,800

[22] Filed: Jan. 13, 1999

[30] Foreign Application Priority Data

Jul. 17, 1996 [DE] Germany ..... 196 28 893
Jul. 16, 1997 [WO] WIPO ..... PCT/EP97/03816

[51] Int. Cl.[7] ..... C09K 3/00; C04B 9/02; C23F 11/00

[52] U.S. Cl. ..... 252/392; 508/285; 106/14.14; 106/14.15; 106/14.31; 422/12

[58] Field of Search ..... 508/285; 252/392; 106/14.14, 14.15, 14.31; 422/12

[56] References Cited

U.S. PATENT DOCUMENTS

| | | | |
|---|---|---|---|
| 2,926,169 | 2/1960 | Hughes | 548/313.7 |
| 2,987,522 | 6/1961 | Shen | 540/603 |
| 3,017,356 | 11/1962 | Hughes et al. | 507/242 |
| 3,450,646 | 6/1969 | Annand et al. | 507/219 |
| 3,531,496 | 9/1970 | Annand et al. | 528/321 |
| 3,584,008 | 6/1971 | Redmore | 548/112 |
| 3,585,210 | 6/1971 | Redmore | 548/112 |
| 3,669,612 | 6/1972 | Annand et al. | 422/7 |
| 3,711,404 | 1/1973 | Redmore | 507/236 |
| 3,758,493 | 9/1973 | Maddox, Jr. | 260/309.6 |
| 4,388,213 | 6/1983 | Oppenlænder et al. | 252/392 |
| 4,886,612 | 12/1989 | Higaki et al. | 508/278 |
| 5,393,464 | 2/1995 | Martin et al. | 252/389.23 |

FOREIGN PATENT DOCUMENTS

| | | |
|---|---|---|
| 0230035 | 7/1987 | European Pat. Off. . |
| 0526251 | 2/1993 | European Pat. Off. . |
| 0540895 | 5/1993 | European Pat. Off. . |
| 3109826 | 9/1982 | Germany . |
| 4217534 | 12/1993 | Germany . |
| 9211243 | 7/1992 | WIPO . |

OTHER PUBLICATIONS

J. Geibel, et al., "Model Compounds for R–State and T–State Hemoglobins," *Journal of the American Chemical Society*, vol. 100, No. 11, May 24, 1978, pp. 3575–3585.

Chemical Abstract 105:42539z, *Chemical Abstracts*, Columbus, Ohio, No. 5, p. 712, Aug. 4, 1986.

*Primary Examiner*—Gabrielle Brouillette
*Assistant Examiner*—Monique T. Cole
*Attorney, Agent, or Firm*—Madan, Mossman & Sriram, P.C.

[57] ABSTRACT

The invention relates to the use of at least one compound of general formula (I), (I)

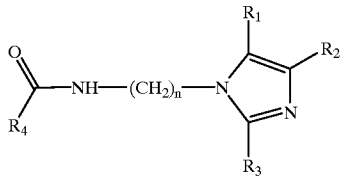

in which $R_1$, $R_2$ and $R_3$ independently of one another represent a hydrogen atom or an alkyl or alkenyl radical; $R_4$ represents an alkyl or alkenyl radical, and n represents 1 to 5; or of an acid addition salt thereof, as an inhibitor of corrosion in the extraction, processing, storage and transportation of crude oil and natural gas, and to a process for the preparation of this compound.

6 Claims, No Drawings

CORROSION INHIBITION

The invention relates to the use of 1-amidoalkylimidazoles as corrosion inhibitors in the petrochemical industry and to a process for the preparation of 1-amidoalkylimidazoles.

It is generally known that in the extraction of crude oil and natural gas, phase mixtures, such as e.g. crude oil/water mixtures, natural gas/gas condensate mixtures or natural gas/gas condensate/water mixtures, are obtained. The aqueous phase in such cases can comprise various amounts of gaseous substances, such as hydrogen sulphide and carbon dioxide, and salts, depending on the origin of the reservoirs. This content of aggressive constituents, in particular the mixture of carbon dioxide and hydrogen sulphide known as acid gas, leads to considerable corrosion problems on the plant components, which are often made of low-alloy steels. Counter-measures to protect extraction, transportation, storage and processing plants from corrosion are therefore necessary.

In crude oil and natural gas extraction, it is therefore generally customary to employ corrosion inhibitors during transportation, storage and, where appropriate, further processing of the phase mixtures obtained, in order to minimize the corrosion damage. Corrosion inhibitors are usually surface-active substances which form a protective coating on the surface of the metal components which come into contact with the aggressive medium, and thus suppress corrosion. A large number of product classes which are used as corrosion inhibitors under the conditions mentioned are known from the prior art.

Conventional corrosion inhibitors comprise, for example, amines, condensation products of fatty acids with polyamines, i.e. imidazolines, or quaternary ammonium compounds (usually based on fatty amines). The most frequently used corrosion inhibitors in crude oil and natural gas extraction include imidazoline derivatives.

U.S. Pat. No. 3,758,493, for example, thus describes carboxylic acid salts of 1-aminoalkylimidazolines of the formula IV (IV)

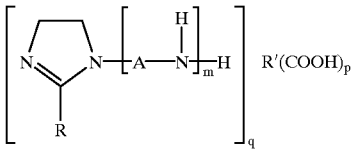

in which R represents the radical of a dimeric or trimeric fatty acid and R', m, p and q have various meanings, as corrosion inhibitors for crude oil and natural gas production.

U.S. Pat. No. 5,393,464 describes corrosion inhibitors for crude oil production which comprise, in combination with phosphate esters, ethoxylated imidazolines of the formula V (V)

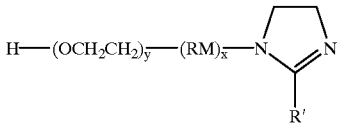

in which R' is derived from a mono- or polyunsaturated fatty acid having 6 to 30 carbon atoms, y represents 1 to 30 and x, R and M have various meanings. These corrosion inhibitors are said to be distinguished by a low toxicity and improved biodegradability.

EP-A-0 526 251 discloses imidazolines of the formula VI (VI)

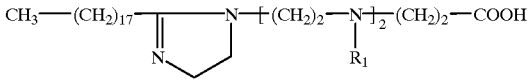

in which $R_1$ represents H or $(CH_2)_2COOH$, which are used as corrosion inhibitors in crude oil and natural gas production. The compounds of the formula VI are prepared by reacting an amine which carries the imidazoline group with an unsaturated or halogenated carboxylic acid.

However, the corrosion inhibitors of the formula IV, V and VI described above are still not completely satisfactory in respect of their action and/or ease of preparation.

German Patent Application 31 09 826 discloses imidazolines of the formula VII (VII)

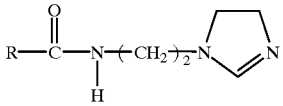

in which R represents a $C_7$–$C_{25}$-alkyl or alkenyl radical. These compounds are added as corrosion inhibitors to water-in-oil emulsions, such as are obtained, for example, in crude oil extraction. These compounds are prepared by reacting a suitable fatty acid with diethylenetriamine. Corrosion inhibitors of the formula VII are thus indeed easy to prepare, but like most other imidazoline corrosion inhibitors known from the prior art, do not have satisfactory toxicity values or satisfactory biodegradability. These disadvantages are particularly serious if the substances are to be employed as corrosion inhibitors in the context of offshore extraction of crude oil and natural gas.

The present invention is therefore based on the object of providing effective corrosion inhibitors for the petrochemical industry which are simultaneously easy to prepare and more ecotoxicologically acceptable than the corrosion inhibitors usually used. In particular, these compounds should have a lower toxicity to microorganisms, be more easily biodegradable and have a lower bioaccumulation potential.

Surprisingly, it has been possible to achieve this object by providing compounds of the formula I (I)

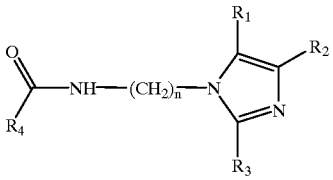

in which $R_1$, $R_2$ and $R_3$ independently of one another represent a hydrogen atom or an alkyl or alkenyl radical, $R_4$ represents an alkyl or alkenyl radical and n represents 1 to 5, or the acid addition salts thereof, as a corrosion inhibitor in the petrochemical industry. The compounds of the formula I are particularly suitable as inhibitors of corrosion during extraction, processing, storage and transportation of crude oil and natural gas.

This is caused, above all, by the content of $CO_2$, $H_2S$ and salt in the aqueous emulsions obtained during extraction.

Compounds of the general formula I are known per se. DE-A-42 17 534 thus describes e.g. compounds of the general formula VIII (VIII)

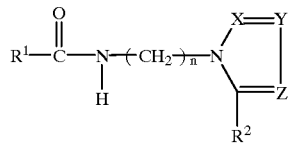

in which $R^1$, $R^2$, X, Y, Z and n can have various meanings.

Imidazoles of the formula VIII in which X=Y=C—H, Z=N, $R^2$=H, n=2 and $R^1$ is a long-chain hydrocarbon radical, for example, are described concretely.

These compounds are used, inter alia, as corrosion preventives in aqueous systems, since in these they suppress oxygen-related corrosion on nonferrous metals, such as e.g. of copper pipes. Their use as preservatives, disinfectants and textile auxiliaries is furthermore proposed. Use of compounds of the formula VIII as corrosion inhibitors in the petrochemical industry, in particular for suppressing corrosion effects caused by the presence of $CO_2$, $H_2S$, sulphur dioxide and/or salts, is not proposed in this publication. German Patent Application 42 17 534 furthermore proposes preparation of the imidazole derivatives of the formula VIII by transition metal-catalysed reaction of oxazolidine and imidazole. However, this synthesis route is extremely involved and therefore not satisfactory.

The compounds used according to the invention offer the surprising advantage of a lower toxicity to microorganisms, an easier biodegradability and a lower bioaccumulation potential. These advantages are of particular importance in the offshore extraction of crude oil and natural gas.

The compounds used according to the invention can therefore be added to the aqueous emulsions obtained in crude oil and natural gas extraction with a very much lower risk to the environment.

In the compounds of the formula (I) used according to the invention, $R_1$, $R_2$ and $R_3$ preferably independently of one another represent a hydrogen atom or a straight-chain or branched, optionally mono- or polysubstituted alkyl or alkenyl radical.

Alkyl radicals which can be used according to the invention in respect of $R_1$, $R_2$ and $R_3$ include, in particular, $C_1$–$C_{10}$-alkyl radicals which have straight-chain or branched, saturated carbon chains having 1 to 10 carbon atoms. The following radicals may be mentioned as examples: $C_1$–$C_6$-alkyl radicals, such as methyl, ethyl, n-propyl, i-propyl, n-butyl, sec-butyl, i-butyl, t-butyl, n-pentyl, sec-pentyl, i-pentyl, n-hexyl and 1-, 2- or 3-methylpentyl, and longer-chain alkyl radicals, such as unbranched heptyl, octyl, nonyl and decyl, and the branched analogues thereof.

Alkenyl radicals which can be used according to the invention in respect of $R_1$, $R_2$ and $R_3$ include, in particular, $C_2$–$C_{10}$-alkenyl radicals which have straight-chain or branched carbon chains having at least one carbon—carbon double bond and having 2 to 10 carbon atoms. Examples of monounsaturated $C_2$–$C_{10}$-alkenyl radicals which may be mentioned are: vinyl, allyl, 1-propenyl, isopropenyl, 1-, 2- or 3-butenyl, methallyl, 1,2-dimethylallyl and 1-, 2-, 3-, 4- or 5-hexenyl; and longer-chain radicals, such as unbranched heptenyl, octenyl, nonenyl and decenyl, and the branched analogues thereof, it being possible for the double bond to occur in any desired position. Both the cis and the trans isomers of the above $C_2$–$C_{10}$-alkenyl radicals are also included according to the invention.

In the compounds of the general formula I used according to the invention, $R_4$ preferably represents a straight-chain or branched, optionally substituted alkyl or alkenyl radical.

Radicals $R_4$ which can be used according to the invention are, in particular, straight-chain or branched, saturated carbon chains having 1 to 30 carbon atoms. The following radicals may be mentioned as examples: a $C_1$–$C_{10}$-alkyl radical according to the above definition; a longer-chain alkyl radical, such as unbranched undecyl, lauryl, tridecyl, myristyl, pentadecyl, palmityl, heptadecyl, stearyl, nonadecyl, arachinyl, behenyl, lignoceryl, ceryl and myricyl, and the mono- or polybranched analogues thereof. Preferred long-chain radicals are derived from $C_6$–$C_{22}$-carboxylic acids, such as e.g. pentyl, heptyl, lauryl, myristyl, palmityl, stearyl, arachinyl and behenyl.

Radicals $R_4$ which can be used according to the invention are, in particular, also straight-chain or branched carbon chains having at least one carbon-carbon double bond and having 2 to 30 carbon atoms. Examples of monounsaturated $C_2$–$C_{30}$-alkenyl radicals which may be mentioned are: monounsaturated $C_2$–$C_{10}$-alkenyl radicals according to the above definition; longer-chain radicals, such as unbranched undecenyl, dodecenyl, tridecenyl, pentadecenyl, palmitoleyl, icosenyl and triacontenyl, and the branched analogues thereof, it being possible for the double bond to occur in any desired position. Both the cis and the trans isomers of the above $C_2$–$C_{30}$-alkenyl radicals are also included according to the invention. Preferred monounsaturated radicals are oleyl and palmitoyl.

Substituents on the radicals $R_1$, $R_2$, $R_3$ and $R_4$ which are suitable according to the invention are OH and $NH_2$, it being possible for the radicals to be mono- or polysubstituted, preferably mono- or disubstituted by identical or different substituents.

The radicals $R_1$, $R_2$, $R_3$ and $R_4$, preferably the radical $R_4$, can furthermore represent mono- or polyepoxidized, preferably monoepoxidized, alkyl radicals. In this case, the alkyl radical has the abovementioned size.

The use of compounds in which $R_1$=$R_2$=$R_3$=H, n represents an integral value from 1 to 5 and $R_4$ represents a $C_5$–$C_{21}$-alkyl or alkenyl radical is preferred according to the invention.

Compounds of the formula (I) in which $R_4$ is derived from saturated or unsaturated fatty acids having 6 to 22 carbon atoms are particularly preferred here. All the naturally occurring or synthetic, linear or slightly branched, long-chain monocarboxylic acid which are to be summarized under the term "fatty acids" in the broadest sense are suitable in this context. Typical examples of these are hexanoic acid, octanoic acid, 2-ethylhexanoic acid, nonanoic acid, decanoic acid, lauric acid, myristic acid, palmitic acid, stearic acid, oleic acid, elaidic acid, linoleic acid and linolenic acid. Fatty acid mixtures, in particular naturally occurring fatty acid mixtures, such as coconut or tallow fatty acids, can also be employed.

Fatty acids having 12 to 22 C atoms, in particular 16 to 20 C atoms, and mixtures thereof are of particular interest. Of these, mono- or polyunsaturated fatty acids or corresponding mixtures of predominantly mono- or polyunsaturated fatty acids, i.e. having a proportion of such unsaturated $C_{16}$–$C_{20}$-monocarboxylic acids of at least 60 wt. %, in particular 80 wt. %, are in turn preferred.

The invention furthermore relates to a process for the preparation of a compound of the general formula I (I)

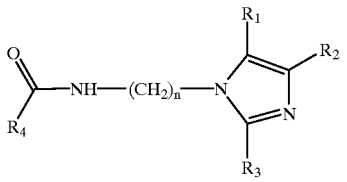

in which $R_1$, $R_2$ and $R_3$ independently of one another represent a hydrogen atom or an alkyl or alkenyl radical, $R_4$ represents an alkyl or alkenyl radical and n represents 1 to 5, or of an acid addition salt thereof, which is characterized in that an aminoalkylimidazole of the general formula II (II)

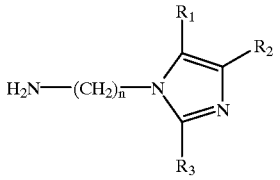

in which $R_1$, $R_2$, $R_3$ and n have the abovementioned meanings, is reacted with a carboxylic acid of the general formula III (III)

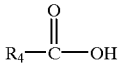

in which $R_4$ has the abovementioned meanings, and, if appropriate, the resulting product is converted into the corresponding acid addition salt.

The 1-aminoalkylimidazoles of the formula II employed in the process according to the invention are likewise generally known compounds which are available as commercial products. They can be prepared, for example, in accordance with the process described in Houben-Weyl, Methoden der organischen Chemie [Methods of organic Chemistry] vol. E 16d, p. 755 et seq., Georg-Thieme-Verlag Stuttgart, 1992.

The process according to the invention for the preparation of the compounds of the general formula (I) is carried out by condensation of the carboxylic acid (III) with the 1-aminoalkylimidazole derivative (II) at 120 to 220° C., preferably at about 150 to 170° C. The product is then freed from water which has not yet distilled off by application of a vacuum at a higher temperature.

The synthesis of amides by reaction of carboxylic acids with amines is described generally in the literature (Houben-Weyl, Methoden der organischen Chemie [Methods of Organic Chemistry], vol. E5, p. 941–966, Georg-Thieme-Verlag, Stuttgart, 1985). However, the preparation of the compound class of the general formula (I) by this route is not yet known from the literature.

In a preferred embodiment, the water of reaction can easily be distilled off by employing a solvent which forms an azeotropic mixture with water (e.g. xylene). In another preferred embodiment of the process according to the invention, the mixture is stripped with inert gas (e.g. nitrogen) during the reaction for rapid and complete removal of the water of reaction formed.

According to another preferred embodiment of the process according to the invention, condensation catalysts, such as acids (e.g. phosphorous acid or hypophosphorous acid) are employed, usually about 0.01 to 0.5 wt. %, based on the fatty acid mixture, of these being used. The amidation also takes place without addition of a catalyst under the conditions mentioned, but then more slowly.

For carrying out the preparation process according to the invention, a ratio of the substance amounts of the carboxylic acid employed to the 1-alkylaminoimidazole derivatives employed in the range from about 10:1 to about 1:10 is chosen, but a ratio of about 1:1 is particularly preferred.

For neutralization, i.e. for partial or complete conversion into the corresponding acid addition salts, the resulting condensation product of the general formula I is expediently reacted with an acid at moderately elevated temperatures, i.e at about 40 to 150° C. The reaction with the acid is usually carried out in a molar ratio of about 5:1 to 1:1, preferably about 2:1 to 1.1:1, in particular about 1.7:1 to 1.2:1, based on the amine number and acid number. Suitable acids here are sulphonic acids, sulphuric acid, phosphoric acid and carboxylic acids. Carboxylic acids and carboxylic acid mixtures are particularly preferred, above all the same mixture of predominantly unsaturated $C_{16}$–$C_{20}$-fatty acids which is also used as the preferred starting substance for the preparation of the compounds of the formula I.

For better metering, the compounds of the general formula I and the acid addition salts derived therefrom can optionally be diluted to a ready-to-use form in an organic solvent. The organic solvent is usually an aliphatic or aromatic hydrocarbon or a hydrocarbon mixture, an aliphatic alcohol or a mixture thereof, or a polyalkylene glycol, ester or ethoxylated, propoxylated or butoxylated alcohol or polyol. Typical examples of these are toluene, xylene, heavy solvent naphtha, Solvesso® brands, methanol, nonanol, Solvenol PC, ethylhexyl acetate, isopropanol, ethylene glycol, diethylene glycol, propylene glycol, propylene diglycol and butylene glycols.

It is furthermore possible to mix the inhibitors according to the invention with other substances, e.g. additional inhibitors or auxiliaries. Examples of these which may be mentioned are: customary dimeric and trimeric fatty acids, such as, for example, a technical grade mixture of dimeric and trimeric fatty acids having acid numbers of 190 to 210; and customary surfactants, in particular nonionic surfactants, such as, for example, nonylphenol ethoxylates. These customary additives can be admixed to the corrosion inhibitors according to the invention in proportions of about 5 to 200 wt. %, such as e.g. 10 to 100 wt. % or 15 to 50 wt. %, based on the total weight of the corrosion inhibitor of the formula I.

In comparison with the known products, the compositions thus obtained show good protection against $H_2S$ and $CO_2$ corrosion and improved properties in respect of bioaccumulation, toxicity and biodegradability.

The inhibitors used according to the invention may be added to the crude oil emulsion obtained in amounts of about 2 to 1,000 ppm, in particular about 10 to 50 ppm— based on the emulsion—depending on the origin and composition. The inhibitors used according to the invention can be employed for this purpose as the pure substance, in the form of an aqueous solution or as a dispersion.

The invention is further described with reference to the following non-limitng Example.

EXAMPLE 1: Preparation of an amide from aminopropylimidazole and 2-ethylhexanoic acid.

125 g (1 mol) of aminopropylimidazole and 1.63 g of phosphorous acid are initially introduced into a 1 litre round-bottomed flask and are heated to 80° C. 144 g (1 mol) of 2-ethylhexanoic acid are slowly added dropwise thereto. The mixture is then heated to 165 to 175° C. and stirred at this temperature for 10 to 12 hours. The water which has distilled off is collected during this operation. The product is freed from the water formed at 100 to 120° C. under 10 mbar for 2 to 4 hours. After cooling to room temperature, 257 g of a red-brown oil, which is identified as the amide, are obtained.

Yield>95%

IR: 1646 $cm^{-1}$ (C=O, amide)

AcN (acid number)<0.2 mmol/g;

AmN (amide number)<2.6 mmol/g

EXAMPLE 2: Preparation of an amide from aminopropylimidazole and oleic acid 162 g (1.3 mol) of aminopropylimidazole are initially introduced into a 1 litre round-bottomed flask and are heated to 80° C. 366 g (1.3 mol) of oleic acid are slowly added dropwise thereto. The mixture is then heated to 155 to 165° C. and stirred at this temperature for 6 to 8 hours. During this operation, it is stripped with $N_2$. The water which has distilled off is collected. After cooling to room temperature, 502 g of a red-brown oil, which is identified as the amide, are obtained.

Yield>95%

IR: 1646 $cm^{-1}$ (C=O, amide)

AmN:<4.3 mmol/g

EXAMPLE 3: Preparation of the acid addition salt 60 g of the product from example 2 are initially introduced into the reaction vessel at room temperature and 8.5 g of oleic acid are added dropwise. The mixture is then stirred at 80° C. for 2 hours.

EXAMPLE 4: Preparation of the acid addition salt 60 g of the product from example 2 are initially introduced into the reaction vessel at room temperature and 17 g of oleic acid are added dropwise. The mixture is then stirred at 80° C. for 2 hours.

EXAMPLE 5: Preparation of the acid addition salt 60 g of the product from example 2 are initially introduced into the reaction vessel at room temperature and 27 g of oleic acid are added dropwise. The mixture is then stirred at 80° C. for 2 hours.

EXAMPLE 6: Testing of the corrosion inhibitor action

The activity of the compounds according to the invention is illustrated by the following tests.

1. Wheel test

The corrosion protection from the components mentioned and from the various formulations of these components was tested with the so-called wheel test. This represents a known method for testing corrosion inhibitors. To carry out this test, strips of steel (ST 37) are cleaned with an SiC powder in a rotating drum and are then rinsed with distilled water and a solvent, dried and weighed. The strips of steel are fixed in a special holder in the lid of test bottles. The bottles are then filled with the corrosive test medium in a stream of nitrogen and tightly closed. Various substances are possible as the test medium. As a rule, a mixture of equal parts of 3% strength sodium chloride solution and n-octane, which is saturated with $CO_2$ or $H_2S$ before each test, is used.

The inhibitor to be tested is metered directly into the test bottle. Measurements without addition of a corrosion inhibitor are used as a comparison. The bottles are then incorporated into the "wheel", a type of cylindrical holder in an oven. Good wetting of the coupons and thorough mixing of the contents of the bottle are ensured by rotation around the longitudinal axis (approx. 40 rpm). The test lasts 16 hours, the oven being heated at 80° C. After the end of the test, the coupons are dismantled and the corrosion products are removed with a pickling solution. The coupons are then washed and dried. The dry coupons are weighed.

The protective action (A) of the corrosion inhibitor added is determined from the weight loss ($\Delta W$) of the coupons, corrected by the pickling blank value ($\Delta W_0$) according to the following formula:

$$A(in\%)=100-\Delta W/\Delta W_0$$

$\Delta W$=weight loss with added corrosion inhibitor, $\Delta W_0$ weight loss without corrosion inhibitor.

The weight loss of a coupon with and without addition of a corrosion inhibitor is compared in each case. The following overview shows the test results measured by this method:

TABLE 1

Protective action against corrosion

| | Medium, saturated with | | | |
|---|---|---|---|---|
| | $CO_2$ | | $H_2S$ | |
| Product dose | 10 ppm | 25 ppm | 10 ppm | 25 ppm |
| Example 2 | 56 | 72 | 77 | 76 |
| Example 3 | 56 | 69 | 68 | 82 |
| Example 4 | 52 | 64 | 79 | 80 |
| Example 5 | 49 | 70 | 73 | 76 |

2. Electrochemical test

The activity of corrosion inhibitors can also be determined electrochemically. Measurement of the linear polarization resistance (LPR) is employed as the measurement method for this. The measurement arrangement comprises a glass container with a stirrer and holders for the three electrodes, and a lid with connections for flushing the test arrangement with various gases and a septum for injection of the corrosion inhibitor.

The liquid phase comprises a 30% strength NaCl solution and a hydrocarbon (n-octane) in a volume ratio of 9:1.

Before the start of the test, the liquid phases are saturated with $H_2S$ or $CO_2$. Atmospheric oxygen is displaced from the apparatus by flushing with the particular gas. The n-octane is added only after installation of the electrodes, so that the electrodes come into contact only with the aqueous phase.

When the electrodes are in equilibrium, the inhibitor is added carefully to the hydrocarbon phase through the septum, the mixture being stirred only such that the layering of the hydrocarbon and hydrogen sulphide phase is retained and no mechanical mixing of the two phases takes place. By this arrangement, the protective action measured for the inhibitor also depends on the partition equilibrium between the aqueous and octane phase.

The following values were measured as a dosage of 1 ppm, based on the total liquid phase.

TABLE 2

Protective action against corrosion

| Product dose | Medium, saturated with $CO_2$ 1 ppm | $H_2S$ 1 ppm |
|---|---|---|
| Example 2 | 91 | 88 |
| Example 3 | 94 | 89 |
| Example 4 | 94 | 89 |
| Example 5 | 92 | 84 |

EXAMPLE 7: Determination of the toxicity

The toxicity of the compounds can be determined via the concentration at which 50% of the test microorganisms die. This value is called the $EC_{50}$ value and is stated in mg/l. The toxicity was determined in accordance with EC Directive 79/381/EEC.

While this $EC_{50}$ value is usually less than 1 mg/l for commercially available corrosion inhibitors (e.g. imidazolines according to DE-A 31 09 826 from oleic acid and diethylenetriamine (DETA)), values greater than 10 mg/l are obtained for the substances according to the invention.

EXAMPLE 8: Determination of the biodegradability

The biodegradability of the substances is determined by the Sturm test ($CO_2$ evolution test, OECD 301 B). For commercially available corrosion inhibitors (e.g. imidazolines from oleic acid and DETA), degradation rates of approx. 10% are found in this test ("poorly biodegradable"). In contrast, degradation values of more than 60% within 28 days are surprisingly determined for the compounds according to the invention ("biodegradable").

EXAMPLE 9: Determination of the bioaccumulation potential

The bioaccumulation potential is given by the partition coefficient of a substance in an octanol/water mixture and is expressed as log Po/w. The value is determined in accordance with OECD 107 (vibrating flask method). The partition coefficient log Po/w determined here must be less than 3. While values sometimes up to greater than 6 are found for commercially available corrosion inhibitors, such as e.g. ammonium salts based on fatty amines, partition coefficients which are significantly less than 3 are surprisingly found for the substances according to the invention.

The corrosion inhibitors used according to the invention are therefore ecotoxicologically more acceptable and more readily biodegradable and furthermore show a low tendency towards bioaccumulation.

What is claimed is:

1. A method of inhibiting corrosion during the extraction, processing, storage and transportation of a hydrocarbon selected from the group consisting of crude oil and natural gas comprising adding to the hydrocarbon as an inhibitor of corrosion of steel at least one compound of the general formula I (I)

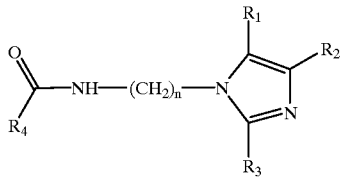

in which $R_1$, $R_2$ and $R_3$ independently are selected from the group consisting of a hydrogen atom, an alkyl radical or an alkenyl radical, $R_4$ is selected from the group consisting of an alkyl radical and an alkenyl radical, and n is 1 to 5.

2. The method of claim 1 where the hydrocarbon further comprises a corrosion causing species selected from the group consisting of $CO_2$, $H_2S$, and salt.

3. The method of claim 1 where in the definition of I:

$R_1$, $R_2$ and $R_3$ independently are selected from the group consisting of a hydrogen atom, a straight-chain or branched $C_1$–$C_{10}$ alkyl radical and a $C_2$–$C_{10}$ alkenyl radical, and $R_4$ is selected from the group consisting of a straight-chain or branched $C_1$–$C_{30}$ alkyl radical or $C_2$–$C_{30}$ alkenyl radical.

4. The method of claim 3 where in the definition of I:

$R_4$ is derived from a saturated or unsaturated, straight-chain or branched $C_6$–$C_{22}$ fatty acid.

5. A method of inhibiting corrosion during the extraction, processing, storage and transportation of a hydrocarbon selected from the group consisting of crude oil and natural gas, and containing a corrosion causing species selected from the group consisting of $CO_2$, $H_2S$, and salt, comprising adding to the hydrocarbon as an inhibitor of corrosion of steel at least one compound of the general formula I (I)

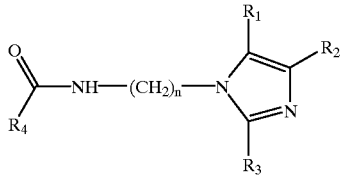

in which $R_1$, $R_2$ and $R_3$ independently are selected from the group consisting of a hydrogen atom, a straight-chain or branched $C_1$–$C_{10}$ alkyl radical and a $C_2$–$C_{10}$ alkenyl radical, $R_4$ is selected from the group consisting of a straight-chain or branched $C_1$–$C_{30}$ alkyl radical or $C_2$–$C_{20}$ alkenyl radical, and n is 1 to 5.

6. The method of claim 5 where in the definition of I:

$R_4$ is derived from a saturated or unsaturated, straight-chain or branched $C_6$–$C_{22}$ fatty acid.

* * * * *